US009045698B2

(12) United States Patent
Lupton et al.

(10) Patent No.: US 9,045,698 B2
(45) Date of Patent: Jun. 2, 2015

(54) METHODS FOR REMOVING CONTAMINANTS FROM OILS USING BASE WASHING AND ACID WASHING

(71) Applicant: UOP LLC, Des Plaines, IL (US)

(72) Inventors: Francis Stephen Lupton, Evanston, IL (US); Praneeth Edirisinghe, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 221 days.

(21) Appl. No.: 13/931,636

(22) Filed: Jun. 28, 2013

(65) Prior Publication Data

US 2015/0005522 A1 Jan. 1, 2015

(51) Int. Cl.
*C11B 3/00* (2006.01)
*C10G 1/00* (2006.01)

(52) U.S. Cl.
CPC ..... *C10G 1/002* (2013.01); *C11B 3/006* (2013.01)

(58) Field of Classification Search
CPC ..... C11B 3/04; C11B 3/12; C11C 1/02; C10G 33/00; C10G 3/00; C10L 1/02; C10L 1/10; C07C 69/587
USPC ..... 554/175
See application file for complete search history.

(56) References Cited

U.S. PATENT DOCUMENTS

| | | | |
|---|---|---|---|
| 4,280,962 | A | 7/1981 | Watanabe et al. |
| 5,315,021 | A | 5/1994 | Beharry et al. |

FOREIGN PATENT DOCUMENTS

| | | |
|---|---|---|
| GB | 1510056 | 5/1978 |
| GB | 2144143 A | 2/1985 |
| WO | 2012031176 A1 | 3/2012 |

OTHER PUBLICATIONS

Alba-Rubio, et al., "A New and Efficient Procedure for Removing Calcium Soaps in Biodiesel Obtained Using CaO as a Heterogeneous Catalyst," Fuel, v 95, p. 464-470, May 2012, ISSN: 00162361, DOI: 10.1016/j.fuel.2011.12.024, Publisher: Elsevier Ltd.

*Primary Examiner* — Deborah D Carr

(57) ABSTRACT

Methods for processing algal oils are provided. In an embodiment, a method for removing a contaminant from an oil includes contacting the oil with a base to form an intermediate solution. Further, the method includes contacting the intermediate solution with an acid to form an acidic solution. The method separates the acidic solution into an oil portion and an aqueous waste portion including the contaminant.

20 Claims, 2 Drawing Sheets

METHODS FOR REMOVING CONTAMINANTS FROM OILS USING BASE WASHING AND ACID WASHING

STATEMENT REGARDING FEDERALLY SPONSORED RESEARCH OR DEVELOPMENT

This invention was made with U.S. Government support under contract number DE-EE0003046 under the National Advanced Algal Biofuels & Bioproducts Consortia. The Government has certain rights in this invention.

TECHNICAL FIELD

The technical field generally relates to methods for removing contaminants from oils, and more particularly relates to methods for removing contaminants from oils using a base washing process followed by an acid washing process.

BACKGROUND

Renewable oils such as triglyceride oils derived from plant or animal sources and pyrolysis oils derived from lignocellulosic biomass sources are known to contain significant amounts of inorganic contaminants such as alkali and alkaline earth metals, as well as chlorides. The presence of inorganic elements in vegetable oils depends on factors such as type of soil, climatic condition, fruit maturity and extraction and pre-treatment procedures. Further, the level of chloride in lignocellulosic biomass is also dependent on the environment where the biomass is grown. Chloride is of particular concern for the hydroprocessing of these oils to produce hydrocarbon fuels due to the possibility of stress corrosion cracking and corrosion associated with the use of high chloride containing pyrolysis oils. The removal of chlorine compounds from renewable oils prior to upgrading to hydrocarbon fuels is highly desirable to mitigate against chloride induced stress corrosion cracking.

The nature of chlorine in renewable oil has a significant impact on approaches for its removal. Chloride contamination in renewable oils occurs as free chloride, complexed chloride, or organically bound chlorine. Inorganic chlorine in the form of chloride anions should be relatively easy to remove by simple hot water washing. Yet, even refined, bleached and deodorized triglyceride oils sold as food grade edible oils have been shown to contain between 1 and 6 ppm of residual chloride anion. In addition to inorganic chlorine in the form of chloride anions, chlorine could be bound covalently to organic molecules in triglyceride and pyrolysis oils. Natural chlorinated fatty acid and other organic molecules are known to be present in oils derived from marine animals and plants.

Conventional algal oil processing has not provided a satisfactorily efficient process for removing chlorine contaminants from algal oil, whether in the form or free chloride, complexed chloride, or organically bound chlorine. Further conventional algal processing has not provide a satisfactorily efficient process for removing metal contaminants from algal oil. For example, typical methods for removing metals from algal oils include the use of bleaching earths or silica absorbents. These materials are expensive, require significant material handling issue and require disposal of a large volume of solid waste.

Accordingly, it is desirable to provide methods for processing algal oils to effectively remove contaminants including metal or chlorine. Further, it is desirable to provide methods for sequentially performing a base wash and an acid wash on an algal oil during processing. Also, it is desirable to remove contaminants from algal oils before being upgraded to diesel or jet fuel. Furthermore, other desirable features and characteristics will become apparent from the subsequent detailed description and the appended claims, taken in conjunction with the accompanying drawing and the foregoing technical field and background.

BRIEF SUMMARY

Methods for processing algal oils are provided. In one embodiment, a method for removing a contaminant from an oil includes contacting the oil with a base to form an intermediate solution. Further, the method includes contacting the intermediate solution with an acid to form an acidic solution. The method separates the acidic solution into an oil portion and an aqueous waste portion including the contaminant.

In another embodiment, a method for processing an algal oil is provided. The method includes delivering the algal oil to a first mixing tank. The method further includes adding a base to the first mixing tank and mixing the algal oil and the base to form a first effluent therein. The first effluent is transferred from the first mixing tank to a second mixing tank. The method includes adding an acid to the second mixing tank and mixing the first effluent and the acid to form a second effluent therein. Further, the method separates the algal oil from the second effluent.

In another embodiment, a method is provided for processing algal oil into jet fuel. The method includes mixing the algal oil with a basic aqueous solution to form a cloudy solution including soap and mixing the cloudy solution with an aqueous acidic solution to form a clear acidic solution and soap solids. The soap solids are separated from the clear acidic solution, wherein the soap solids include the algal oil and the clear acidic solution includes the contaminant. Further, the algal oil is upgraded to form jet fuel having an aromatic concentration of greater than about 10%.

BRIEF DESCRIPTION OF THE DRAWING

Embodiments of methods and apparatuses for processing oils will hereinafter be described in conjunction with the following drawing figure wherein.

DETAILED DESCRIPTION

The following detailed description is merely exemplary in nature and is not intended to limit the methods for processing algal oils. Furthermore, there is no intention to be bound by any theory presented in the preceding background or the following detailed description.

Methods for processing algal oils, and more particularly, for removing contaminants from algal oils are provided herein. The methods effectively remove chlorine and/or metals from algal oil. In exemplary methods, the algal oil is first treated with a weak base before being treated with an acid. Then a separation process, such as a centrifugal separation or phase separation, is performed to remove the treated algal oil from an aqueous mixture including the contaminant or contaminants.

A significant amount of chloride contaminants in algal oils appears to be complexed with components in the oil, such as phospholipids, which contain cationic moieties capable of forming ion pairs with the chloride ions. For most refined triglyceride oils however, only very low levels of free chloride are present. Most of the residual chlorine in these oils appears to be organically bound. It is described herein that washing with a weak base followed by acid washing is required to effectively remove residual chloride anions coordinated with cationic moieties in algal triglyceride oils.

While effective removal of chloride from triglyceride oils with high total chloride requires a combination of weak base washing and acid washing to remove both free chloride anion as well as complexed chloride, the order of washing is important. The wash with a weak base like sodium bicarbonate, potassium bicarbonate, or a weak solution of sodium hydroxide causes a strong emulsion to form with many triglyceride oils. The subsequent acid wash is required to achieve good phase separation and removal of the wash solution. As described herein, the weak base pretreatment followed by acid wash enables the reduction of chlorine in oils with high levels of contamination, such as algal oils, down to a level that is compatible with the enhanced metallurgy used in green or biodiesel refining, i.e. chloride content of less than about 50 ppm.

In addition to chloride contamination, algal oils may include metal or alkali earth metals contaminants such as aluminum, calcium, magnesium, sodium, and potassium. It has been determined that the process including a weak base pretreatment followed by an acid wash treatment is effective in removing metal contaminants. Such treatment reduces metal content in oils from an initial content in the range of 100 ppm to 1000 ppm to a metal content of less than 10 ppm, such as less than 5 ppm.

Figure 1:
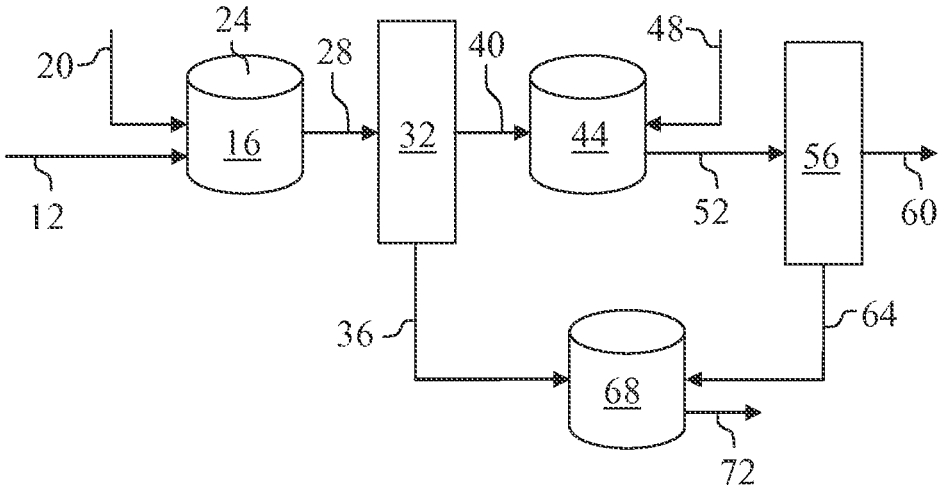
FIG. 1 is a schematic diagram of an embodiment of a method for removing contaminants from an oil in accordance with an embodiment.

Referring now to FIG. 1, a method for removing contaminants from oil is illustrated. As shown, a feed oil 12 containing at least one contaminant is fed into a first mixing tank 16. The feed oil may be a solvent extracted oil produced, for example, by a hexane extraction from algal. While algal oil is currently of commercial interest, the disclosed method is not limited to algal oils, but can be applied to any crude oil having concentrations of chloride or alkali metals of about 1 ppm to about 1000 ppm, such as about 100 ppm.

As shown, a base solution 20 is fed into the first mixing tank 16. An exemplary base solution 20 is 2% sodium bicarbonate, 2% potassium bicarbonate, or a dilute solution of sodium hydroxide having approximately the same pH as a 2% sodium bicarbonate solution. An exemplary base solution 20 has a pH of about 7.5 to about 10.5, such as about 9.5. Further, in the exemplary embodiment substantially equal amounts of the feed oil 12 and the base solution 20 are fed into the first mixing tank.

The feed oil 12 and the base solution 20 are mixed in the mixing tank 16 at an elevated temperature. Specifically, the feed oil 12 and the base solution 20 are mixed at a temperature range of about 40° C. to about 80° C., such as about 50° C. to about 60° C., for example at about 55° C. The feed oil 12 and the base solution 20 are typically introduced to the mixing tank 16 at the desired temperature, though the feed oil 12 and the base solution 20 may be heated in the mixing tank 16.

During mixing in the mixing tank 16, the feed oil 12 and the base solution 20 form an intermediate solution 24. Typically, the intermediate solution 24 is a cloudy solution including soap. The intermediate solution 24 may be agitated in the mixing tank 16 for a selected time period, such as for up to 12 hours. When the contaminant is chloride, it is believed that contact with the base solution 20 causes the chloride to be unassociated as it reaches equilibrium with the bicarbonate or hydroxide ions, e.g., the chloride will be free in the oil, not bound. Specifically, chloride ions are displaced from ion pairs or micelles by the bicarbonate or hydroxide.

After mixing, the intermediate solution 24 is removed from the mixing tank 16 as an effluent stream 28. In the embodiment of FIG. 1, the effluent stream 28 is fed into a separation unit 32, such as a centrifuge. The separation unit 32 separates the soap from aqueous waste. For example, the aqueous waste may include non-toxic alkali metals and inorganic or organic salts such as phosphorus. An aqueous waste stream 36 exits the separation unit 32. Further, the remaining oil 40 is removed from the separation unit 32 and delivered to a second mixing tank 44. It is noted that while the embodiment of FIG. 1 illustrates that the effluent stream 28 passes through the separation unit 32, the effluent stream 28 may be delivered directly to the second mixing tank 44 without undergoing separation.

As shown, an acidic solution 48 is also fed into the second mixing tank 44. An exemplary acidic solution 48 is a 2% concentration of sulfuric acid solution. In an exemplary embodiment, a sufficient amount of the acidic solution 48 should be added so that the resulting solution 52 formed in the second mixing tank 44 has a pH of no more than about 2. The solution 52 is mixed in the mixing tank for a selected period of time, such as for about 4 to about 12 hours.

In an exemplary embodiment, an elevated temperature is maintained during contact between the remaining oil 40 (or the effluent stream 28) and the acidic solution 48 in the second mixing tank 44. For example, the remaining oil 40 (or the effluent stream 28) and the acidic solution 48 are mixed at a temperature range of about 40° C. to about 80° C., such as about 50° C. to about 60° C., for example at about 55° C. The remaining oil 40 (or the effluent stream 28) and the acidic solution 48 are typically introduced to the second mixing tank 44 at the desired temperature, though they may be heated in the second mixing tank 44.

Contacting the remaining oil 40 (or the effluent stream 28) with the acidic solution 48 causes the formation of solution 52 as a clear acidic solution and soap solids mixture. Specifically, the soap is hydrolyzed by the acidic solution 48. The clear acidic solution and soap solids mixture 52 is removed from the second mixing tank 44 and fed to a separation unit 56, such as a centrifuge. In the separation unit 56, oil and water are separated into a product oil stream 60, e.g., a decontaminated triglyceride oil and an aqueous waste stream 64 including the contaminant(s). If the aqueous waste stream 36 was formed by separation unit 32, it may be mixed with the aqueous waste stream 64. The aqueous waste stream 64 or streams 36 and 64 are washed with water in washing tank 68 to remove any polar organics before the waste 72 is discharged.

EXAMPLE 1

Example 1 is provided in accordance with the method provided in FIG. 1. In Example 1, the feed oil 12 is an algal feed oil including 0.6 ppm aluminum, 14.2 ppm calcium, 108 ppm magnesium, 422 ppm sodium, 285 ppm phosphorus, and 442 ppm potassium. After the base wash pretreatment and acid wash treatment, the product oil stream includes 0.2 ppm aluminum, less than 0.2 ppm calcium, less than about 0.2 ppm magnesium, 2.4 ppm sodium, less than 0.3 ppm phosphorus, and 0.6 ppm potassium.

EXAMPLE 2

Example 2 is provided in accordance with the method provided in FIG. 1. In Example 2, the feed oil 12 is an algal feed oil including 218 ppm chloride. After the base wash pretreatment and acid wash treatment, the product oil stream includes 19 ppm chloride.

Figure 2:
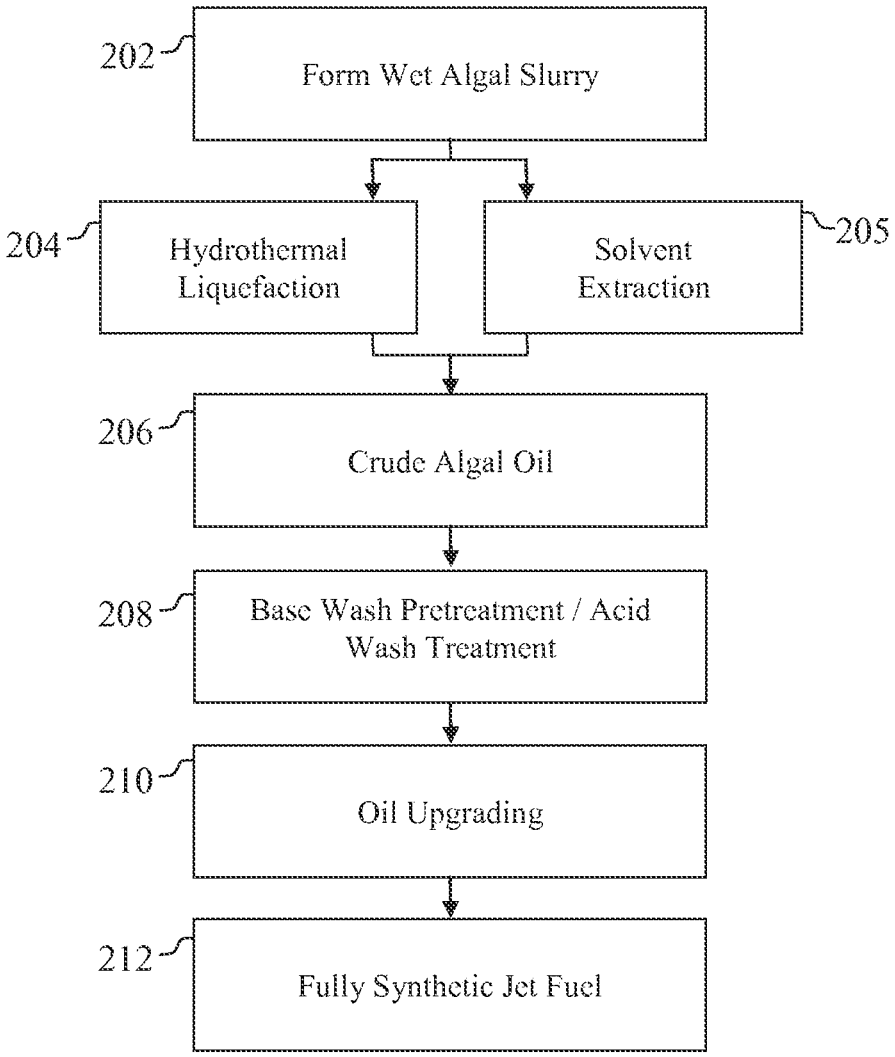
FIG. 2 is a flow chart illustrating method steps for forming a synthetic jet fuel from algal oil.

FIG. 2 illustrates another embodiment of methods for processing oils. Specifically, FIG. 2 illustrates steps for converting wet algal slurry into fully synthetic jet fuel having a greater than 10% concentration of aromatics and a density of about 775 to about 840 grams per liter (g/L). As shown in FIG. 2, a wet algal slurry is provided at step 202 Algae may be formed into a slurry, for example, by adding water to algae so that the slurry has a solid content of from about 1% to about 40%, such as about 4% to about 25%, or about 10%.

At parallel steps 204 and 205, the algal slurry is processing to form an algal crude oil. For example, at step 204, the algal slurry is processed by hydrothermal liquefaction. In exemplary embodiments, the hydrothermal liquefaction process occurs at a temperature above about 350° C. and at a pressure greater than about 172.36 bar (2500 psig). The hydrothermal liquefaction process produces crude algal oil at step 206. Specifically, the hydrothermal liquefaction process produces a bio-oil that has a significant aromatic content, such as greater than about 10%. At alternative step 205, a solvent extraction process is performed to form the crude algal oil at step 206. Known exemplary processes for extracting algal oil use hexane, petroleum ether, or benzene and ether. Solvent extraction processes can derive more than 95% of the total oil present in the algae.

Thereafter, the base wash pretreatment and acid wash treatment discussed in relation to FIG. 1 may be performed on the crude algal oil at step 208 to remove contaminants such as metals. The resulting de-contaminated algal oil is then processed according to a green jet refining technique at step 210. For example, the bio-oil may be upgraded by undergoing deoxygenation and isomerization cracking to isomerize its n-paraffin content. Thus, the bio-oil is upgraded to jet and diesel fuels while preserving its aromatic content. It is noted that metal contaminants would poison the upgrading catalysts if not removed beforehand. At step 212, the resulting fuel is a fully synthetic jet fuel having an aromatic concentration greater than 10% and a density of from about 775 to about 840 g/L.

EXAMPLE 3

Example 3 is provided in accordance with the method of FIG. 2. In Example 3, algal oil is provided with the following components:

N-paraffins: 53.304%
isoparaffins: 7.965%
naphthenes: 23.433%
monoaromatics: 10.863%
diaromatics: 3.749%
triaromatics: 0.686%

Synthetic jet fuel is formed from the algal oil and has the following characteristics:

Density: 786.3 g/L
Freeze point max: −45.8° C.
Flash point min: 61.2° C.
Distillation 10% recovered Temp (T10) ° C. max: 167.8
Distillation 50% recovered Temp (T50) ° C.: 207.4
Distillation 90% recovered Temp (T90) ° C.: 244.6
Final Boiling Point (° C.) max: 273.2
T50-T10 min: 39.6
T90-T10 min: 76.8

EXAMPLE 4

Example 4 is provided in accordance with the method of FIG. 2. In Example 4, synthetic jet fuel is formed from the algal oil and has the following characteristics:

Density: 780.2 g/L
Freeze Point max: −57° C.
Flash point min: 59.6° C.
Distillation 10% recovered Temp (T10) ° C. max: 167
Distillation 50% recovered Temp (T50) ° C.: 203.6
Distillation 90% recovered Temp (T90) ° C.: 242.2
Final Boiling Point (° C.) max: 272
T50-T10 min: 36.6
T90-T10 min: 75.2

As described herein, methods for removing contaminants from oils, such as algal oils have been provided. In exemplary embodiments, a method has been described for forming synthetic jet fuel from algal oil through hydrothermal liquefaction, base wash pretreatment, acid wash treatment and catalytic upgrading though any suitable methods for processing oils may utilize the contaminant removal process disclosed herein.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the claimed subject matter in any way. Rather, the foregoing detailed description will provide those skilled in the art with a convenient road map for implementing an exemplary embodiment or embodiments. It being understood that various changes may be made in the function and arrangement of elements described in an exemplary embodiment without departing from the scope set forth in the appended claims.

What is claimed is:

1. A method for removing a contaminant from an oil, the method comprising the steps of:

contacting the oil with a base to form an intermediate solution;

contacting the intermediate solution with an acid to form an acidic solution; and separating the acidic solution into an oil portion and an aqueous waste portion, wherein the aqueous waste portion includes the contaminant.

2. The method of claim 1 wherein contacting the oil with a base to form an intermediate solution comprises mixing equal amounts of the oil and a 2% basic solution.

3. The method of claim 1 wherein contacting the oil with a base to form an intermediate solution comprises mixing the oil and a basic solution to form a cloudy solution including soap, and wherein the method further comprises agitating the cloudy solution for a selected time period.

4. The method of claim 1 wherein contacting the intermediate solution with an acid to form an acidic solution comprises mixing the intermediate solution with an acid to form an acidic solution having a pH of no more than about 2.

5. The method of claim 1 wherein the intermediate solution is cloudy and includes soap, and wherein contacting the intermediate solution with an acid to form an acidic solution comprises mixing the intermediate solution with an acid to form a clear acidic solution and soap solids.

6. The method of claim 1 wherein separating the acidic solution into an oil portion and an aqueous waste portion comprises separating the acidic solution by centrifugation.

7. The method of claim 1 further comprising separating aqueous waste from the intermediate solution before contacting the intermediate solution with an acid to form an acidic solution.

8. The method of claim 1 further comprising separating aqueous waste from the intermediate solution by centrifugation before contacting the intermediate solution with an acid to form an acidic solution.

9. The method of claim 1 wherein the contaminant comprises a metal, and wherein contacting the oil with a base to form an intermediate solution comprises mixing sodium hydroxide with the oil to form the intermediate solution.

10. The method of claim 1 wherein the contaminant comprises a chloride, and wherein contacting the oil with a base to form an intermediate solution comprises mixing bicarbonate with the oil to form the intermediate solution.

11. The method of claim 1 further comprising washing the aqueous waste portion with water to remove polar organics.

12. A method for processing an algal oil, the method comprising the steps of:

delivering the algal oil to a first mixing tank;

adding a base to the first mixing tank and mixing the algal oil and the base to form a first effluent therein;

transferring the first effluent from the first mixing tank to a second mixing tank;

adding an acid to the second mixing tank and mixing the first effluent and the acid to form a second effluent therein; and separating the algal oil from the second effluent.

13. The method of claim 12 wherein delivering the algal oil to a first mixing tank comprises delivering the algal oil including a metal to a first mixing tank, and wherein separating the algal oil from the second effluent comprises separating the algal oil from the metal.

14. The method of claim 12 wherein delivering the algal oil to a first mixing tank comprises delivering the algal oil including a metal to a first mixing tank, wherein adding a base to the first mixing tank and mixing the algal oil and the base to form a first effluent therein comprises adding bicarbonate to the first mixing tank and mixing the algal oil and the bicarbonate to form a first effluent therein; and wherein separating the algal oil from the second effluent comprises separating the algal oil from the metal.

15. The method of claim 12 wherein delivering the algal oil to a first mixing tank comprises delivering the algal oil including a chloride to a first mixing tank, and wherein separating the algal oil from the second effluent comprises separating the algal oil from the chloride.

16. The method of claim 12 wherein delivering the algal oil to a first mixing tank comprises delivering the algal oil including a chloride to a first mixing tank, wherein adding a base to the first mixing tank and mixing the algal oil and the base to form a first effluent therein comprises adding bicarbonate to the first mixing tank and mixing the algal oil and the bicarbonate to form a first effluent therein; and wherein separating the algal oil from the second effluent comprises separating the algal oil from the chloride.

17. The method of claim 12 wherein adding a base to the first mixing tank and mixing the algal oil and the base to form a first effluent therein comprises forming an effluent comprising a cloudy solution including soap, and wherein adding an acid to the second mixing tank and mixing the first effluent and the acid to form a second effluent therein comprises forming a second effluent comprising a clear acidic solution and soap solids.

18. The method of claim 12 wherein:

adding a base to the first mixing tank and mixing the algal oil and the base to form a first effluent therein comprises mixing substantially equal amounts of the algal oil and a 2% basic solution, and adding an acid to the second mixing tank and mixing the first effluent and the acid to form a second effluent therein comprises mixing the first effluent with an acid to form the second effluent with a pH of no more than about 2.

19. A method for processing algal oil into jet fuel, the method comprising the steps of:

mixing the algal oil including a contaminant with a basic aqueous solution to form a cloudy solution including soap;

mixing the cloudy solution with an aqueous acidic solution to form a clear acidic solution and soap solids;

separating the soap solids from the clear acidic solution, wherein the soap solids include the algal oil and the clear acidic solution includes the contaminant;

upgrading the algal oil to form jet fuel having an aromatic concentration of greater than about 10%.

20. The method of claim 19 further comprising separating an aqueous waste stream from the cloudy solution before mixing the cloudy solution with an aqueous acidic solution, wherein the aqueous waste stream includes a portion of the contaminant.

* * * * *